US007726708B2

(12) United States Patent
Bourrieres et al.

(10) Patent No.: US 7,726,708 B2
(45) Date of Patent: Jun. 1, 2010

(54) TAMPER-PROOF AND REUSABLE HIGH SECURITY SEAL

(75) Inventors: Francis Bourrieres, Montauban (FR); Clement Kaiser, Montauban (FR); Franck Bourrieres, Montauban (FR)

(73) Assignee: Novatec SA, Moutauben (FR)

( * ) Notice: Subject to any disclaimer, the term of this patent is extended or adjusted under 35 U.S.C. 154(b) by 0 days.

(21) Appl. No.: 12/088,916

(22) PCT Filed: Nov. 20, 2006

(86) PCT No.: PCT/FR2006/002564

§ 371 (c)(1),
(2), (4) Date: Apr. 1, 2008

(87) PCT Pub. No.: WO2007/060323

PCT Pub. Date: May 31, 2007

(65) Prior Publication Data

US 2008/0217931 A1 Sep. 11, 2008

(30) Foreign Application Priority Data

Nov. 23, 2005 (FR) ..... 05 11835

(51) Int. Cl.
*B65D 33/34* (2006.01)

(52) U.S. Cl. ..... 292/307 R; 292/307 B

(58) Field of Classification Search ..... 292/307 R, 292/307 A; 24/712.1, 712.3
See application file for complete search history.

(56) References Cited

U.S. PATENT DOCUMENTS 4,118,057 A * 10/1978 Ryan ..... 292/307 R
4,389,063 A * 6/1983 Ryan ..... 292/307 R
6,888,241 B1 5/2005 Korn et al.
7,647,279 B2 * 1/2010 Bourrieres et al. ..... 705/67
2003/0004647 A1 1/2003 Sinclair
2003/0014647 A1 1/2003 Bourrieres et al.
2005/0075984 A1 4/2005 Bourrieres et al.

(Continued)

FOREIGN PATENT DOCUMENTS

EP 1087334 3/2001

(Continued)

OTHER PUBLICATIONS

PCT Search Report for WO2007/060323.

(Continued)

*Primary Examiner*—Peter M Cuomo
*Assistant Examiner*—Kristina R Fulton
(74) *Attorney, Agent, or Firm*—Vidas, Arrett & Steinkraus

(57) ABSTRACT

High security seal that can be reused an indefinite number of times because the authenticating part evolves in a chaotic manner each time the seal is opened and then put back into service. This seal is composed of at least two authenticators (1) and (2) at least one of which is movable with respect to the other into the open position. These two authenticators become fixed and stable in the closed position. In each new fixed position, the two authenticators cooperate to generate a new authenticating feature that is stored in a database in order to be compared during a check. This feature will be cancelled and replaced with another one when said seal is fraudulently or deliberately opened and thus will provide proof that it has been opened.

7 Claims, 3 Drawing Sheets

U.S. PATENT DOCUMENTS

| | | | | |
|---|---|---|---|---|
| 2006/0053303 | A1 | 3/2006 | Borrieres et al. | |
| 2008/0142671 | A1 | 6/2008 | Bourrieres et al. | |
| 2008/0267511 | A1 | 10/2008 | Bourrieres et al. | |
| 2009/0218401 | A1 * | 9/2009 | Moran et al. | 235/439 |

FOREIGN PATENT DOCUMENTS

| | | |
|---|---|---|
| FR | 2848698 | 6/2004 |
| GB | 2304077 | 3/1997 |
| GB | 2324065 | 10/1998 |
| WO | 0111591 | 2/2001 |
| WO | 0233682 | 4/2002 |

OTHER PUBLICATIONS

International Preliminary Examination Report for WO2007/060323.

* cited by examiner

TAMPER-PROOF AND REUSABLE HIGH SECURITY SEAL

CROSS-REFERENCES TO RELATED APPLICATIONS

This application is a US National Stage entry of PCT/FR2006/002564, filed Nov. 20, 2006, designating the United States.

STATEMENT REGARDING FEDERALLY SPONSORED RESEARCH AND DEVELOPMENT

Not applicable

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The invention proposes a very high security reusable security seal without any deterioration or destruction to the mechanism and making it possible to verify the intrusion. This type of seal can be used: either to control and verify the intrusion in a connection or system or unsuccessful attempt maintaining the integrity of an object or its contents by an unauthorized person, or on the contrary, to be opened by an agent in order to control and verify his entry.

2. Background Art

A large number of systems exist to check the intrusion or the attempt of intrusion in a system or a location protected against unauthorized people and to identify and authenticate objects as being originals. The most common modern methods are:

- electronic alarms, these systems set off an alarm when there is intrusion when the alarm is not stopped beforehand using a secret code, for example, or an authorized biometric print.
- video surveillance systems make it possible to record or control in real time the access or crossing points,
- cards (with chip, magnetic . . . ), secret codes or biometrics make it possible to control access to the location or protected system.

All these methods are adapted to the access and exit controls from persons in private or public places. For security of system access or even the prevention of general access in a location or system, except by authorized staff, safety seals are generally used, making it possible to restrict and prohibit intrusion in the system or in the protected location. Seals are also used to guarantee the integrity or the authenticity of an object. These seals can take various forms according to the application. Inspection of the physical integrity of the seal makes it possible, in theory, to ensure that there is no violation of the system or the object. The name "system" is taken in the broad sense, it can be, for example, an assembly of associated elements or a unit or unspecified conditions such as a bottle requiring preservation of content integrity, it can also be an information system.

The present invention particularly focuses on the application of processing significant data as will be further described.

The oldest seal is the wax seal, generally marked with the seal of authority. There are also metal seals or plastic ones integrating a collar identifier appearing upon progressive tightening. These seals are not reusable because their destruction is irremediable when there is violation of the location or protected system. There are also "beaded" metal seals in the form of grooved threads whose two ends are crimped in a section of soft metal, generally lead, using a special grip that marks a seal in relief the aforementioned lead section; this is also called a filling. This last type of seal is often used on water, gas, and electric meters in order to prohibit access to the electrical or mechanical measuring device. In the same way, in the great family of seals, we can arrange identification plates or supports of all types which are very often metal plates, engraved or stamped plastic or printed. These plates or supports in general identify an object, a complex system or a machine or an individual through an identity card, this support being the delivered marked seal of authority that makes it possible to authenticate. The applications implementing identification plates or supports are numerous and varied, among the most frequent one can find: motor vehicles that have manufacturer identification plates and inspection number plates; identification plates and homologation of machine tools; plates on materials and electric and electronic machines, etc. . . . In general, these identification plates are indexed in files or in manufacturer or administration databases.

All these types of identification seals or supports present two major disadvantages: the first is that they are very easily reproducible with identical average synopses, including the authenticating element or seal, besides it is possible to get them in great quantity on the market; the second, is the substitution of an object or protected system. For some of them, the connection between the seal or the support and the parts necessary to prohibit separation or opening are ineffective and can be easily destroyed by preserving intact the seal or support; for example, a joint that could be dissolved by a chemical or suitable solvent which will make it possible to recover the seal, to reach the closed area and to reposition the seal in the same place, and thus to have reached or modified data without detection. It also becomes possible to substitute an original product seal with a copy and thus make the copy pass for the original.

Another major problem is the ratio of cost/security. In general, the more secure, the higher the cost, which poses a major problem for large applications that consume seals and where one would need simultaneously a low cost with a high level of security that contradicts current solutions.

In the same way, to prohibit physical access to electronic systems containing confidential data, it has become common to use very specific holograms and even for some high security systems. However, the high security qualifier was adapted certainly more in the past than at the present time through actual means allowing them to very easily be reproduced identically with a level of quality comparable with the original.

Moreover holograms are not individualized, i.e. they all are identical in the same series and so it becomes easy for an unauthorized person to get these holograms, to open the protected case by destroying the hologram and replace it by a fully identical new one. If it is not possible to get the hologram, the counterfeiter can always separate it from the case without destroying it and in the same way position it back. Thus in one way or another, it becomes extremely easy for a determined person to violate a system and physically reach confidential data, for example in a black box containing memory storage or to substitute an object for another. In a general way and whatever the method used, the security seal must on the one hand prevent physically compromising the container access and contents, and on the other hand, expose such intrusions when despite everything this has occurred. A security seal does not have the ability to make attacks against a system or access to a location or unspecified container impossible; on the other hand if it is well designed and integrated on the product or location to be protected, it will dissuade the eager attacker and leave evidence of the attempt. It acts above all of as a means of defense, which on the average is able to highlight an attack attempt on the physical integrity of the system or object on which it is assembled. According to the application, the seal known as the security seal can take several forms. A seal is in fact an average joint performing a union between itself and one or more elements marked by an authorized seal (seal of State for example).

In all these applications, the problems are precisely the possibility of identically reproducing these seals for fraudulent access to the physical contents of the location or the system.

The protected patent FR2848698 from the same applicant and inventor, concerns a process of identification and authentication without a specific reader of an object or a living being. In this document, it is recommended to attach an identifier difficult or impossible to reproduce within the object or living being to identify or authenticate. As noted, this document does not refer to a system monitoring non-intrusions of a protected location or the integrity of an object and that is precisely the object of this invention. The process described in document FR2848698 does not make it possible in any case to guarantee system or protected location breeches. Indeed, the fact of affixing an identifier on an object does not prevent gaining access to the object, modifying it, analyzing it, and from replacing the same identifier without detection even if this is not reproducible. In the worst cases, it is even possible to take the authenticator without destroying the object and affix it to another object.

Document WO 01/11591 describes a device which makes it possible to identify objects. This identifier has the effect of comprising a matrix of lenses which generates a visual effect in three dimensions, which does not want to claim that it is not reproducible. What is revealed in this document completely differs from this invention primarily in that:

- following the example of patent FR2848698, this identifier does not allow guarantee of the opening description or the intrusion of the object or the protected location.
- The identifier described in this document is reproducible ad infinitum since it rests certainly on a manufacturing process, complex but completely controlled. Consequently the uniqueness of this identifier is not assured.
- The identifier is not associated with a database.

Document EP 1087334 describes a system of seals calling upon a transponder which makes it possible to contain remote electronic and questionable identification. This type of transponder is not unique since it is completely possible for a person or an organization having production means of producing several having the same number. Consequently, it is completely possible to open the device described to access its contents and to completely reconstitute two capsules identical to the first answers with a transponder giving the same answer as the first. In fact, the fault of this type of device is in the supply chain of the capsules and transponders, if a person or unscrupulous organization can divert parts, it will be able to reconstitute the seal identical to the first. Moreover this type of seal is not reusable after opening. In the present invention, as will be seen hereafter, the process of non-intrusion rests on a unique authenticator and is not identically reproducible and recorded in a database, consequently, even if a person manages to subtilize authenticators, the latter will not aid any utility because they will not be recorded in the dated base.

Patent WO02/33682A describes a reusable seal where passage of the closed position to the open position implies activation of a random electronic code generator. The reading of this code displays if the seal was open if the code changed or on the contrary, was not opened if the code did not change. If the goals of this patent are identical to those of this invention, not only are the means different but also the results in terms of security are much higher in the developed invention. Indeed, proof of non-entry is delivered in this patent by the reading of an electronic posting, but such a posting can be identically reproduced from knowledge of the generation code algorithms. In the same way, without knowing the generation code algorithms, this reusable seal can be substituted by another that is at all points identical where a posting can reveal a code identical to the original, but the programming will have been performed by an internal electronic system that counterfeits codes on demand. It is thus completely impossible to interchange this type of seal by another with the having identical authenticating characteristics.

The patent U.S. Pat. No. 4,118,057 describes a reusable seal where the authenticating characteristic part is provided by the random fitting of various colors balls appearing in a window. The extremely high number of combinations makes it possible to affirm that it is impossible to reproduce two identical consequent combinations to secure the opening or unseal it. The system is completely mechanical, it does not have electronics, the substitution of a seal by another seal in all points identical and providing the same arrangement of balls is theoretically possible because even the balls are perfectly reproducible in size and color. So it is enough to reach the display window and to position identical balls. In this manner, if it appears difficult to modify the device in the course of use, it is always easy to prepare another similar device prepared in advance for an identical arrangement of the authenticating part, i.e. the identical positioning of colored balls.

U.S. Pat. No. 2003/0014647 describes authenticators with bubbles, always unique and impossible to reproduce with the associated means to interpret it. This bubble authenticator, although impossible to reproduce, cannot act alone within the framework of this invention for a reusable seal because it cannot prove that a seal was not opened and closed again. On the other hand, as that will be seen in the description of the invention hereafter, this type of authenticator is particularly well adapted to the present invention as individual authenticator, associated with another authenticator of comparable type, but inevitably different in these characteristics. The unit cooperates in a chaotic manner to obtain an infinite number of new stable nonreproducible positions.

BRIEF SUMMARY OF THE INVENTION

In an embodiment the invention pertains to a high security reusable seal comprising a plurality of authenticator layers having a multiplicity of three-dimensional identifying features, wherein a) the three-dimensional identifying features of each authenticator layer comprise heterogeneities fixed in the authenticator layer in random distribution, b) the seal is transitionable between an open position and a closed position, c) in the open position the authenticator layers are movable relative to each other, d) in the closed position, i) the authenticator layers are fixed relative to each other, and ii) at least a portion of the three-dimensional identifying features of each of said authenticator layers are detectable through said layers and, in combination, form a seal authenticating characteristic, e) in transitioning from the open to the closed position at least one of the authenticator layers moves relative to the other randomly such that each closing transition produces a novel seal authenticating characteristic, and f) in transitioning from the closed to the open position at least one of the authenticator layers moves relative to the other randomly such that each opening transition cancels a previous seal authenticating characteristic.

BRIEF DESCRIPTION OF THE SEVERAL VIEWS OF THE DRAWING(s)

FIG. 1*a* is a schematic sectional view of a seal of the invention in an open position.

FIG. 1*b* is a view of the seal of FIG. 1*a* but in a closed position.

FIG. 1*c* is a top plan view of a seal of FIGS. 1*a* and 1*b*.

FIG. 2 provides photographic component images of two authenticators and composite images obtained therefrom with a seal of the invention in three successive releases and closings.

FIG. 3 provides photographic images of the same series as FIG. 2 obtained under different lighting conditions.

DETAILED DESCRIPTION OF THE INVENTION

The invention aims for a total solution to the following difficulties which arise in the use of the known seals:

1) to make the seals non-interchangeable between them 2) to make physically interdependent the system seal or location or object to be protected, so that if there is an intrusion or simply an attempt of intrusion or substitution, the seal itself is visibly marked.

3) to make the seal reusable after each use in order to reduce costs while preserving a very high level of security.

4) to be able to control on the spot if there was or was not an opening or attempt of opening.

According to a first characteristic particularly innovative and inventive, the high security seal of the invention is indefinitely reusable, while making it possible to detect and prove openings and closings which corresponds to a new re-use. This essential characteristic constitutes the heart of the invention, lying in the fact that it obtains a new authenticating characteristic each time that it is opened and consequently closed again to be brought into service. It is characterized in that it integrates a device allowing the uncontrolled evolution of its authenticating characteristic into each change of state, i.e., at the time of moving from the closed to open position (FIG. 1A) cancelling the preceding authenticating characteristic and of the open to closed position (FIG. 1B) restoring a new authenticating characteristic thanks to the chaotic self-generation of new authenticating characteristics caused by the aforementioned change of state. Each authenticating characteristic is stored in a protected memory or bench-mark database in order to prove if there was an opening or attempt of opening of the seal.

Another characteristic of the invention makes use of at least two authenticators 1, 2 that always show unique and nonreproducible identical characteristics in order to avoid their duplications. At least one of the known authenticators acts separately in an unstable manner when the seal is in the unblocked position (FIG. 1A) or opened and acts jointly in a stable and readable way when the seal is in the closed and blocked position (FIG. 1B). Another invention characteristic is the joint and stable action of the nonreproducible individual authenticators 1, 2 that allows the generation of new common authenticators 15, 16, 17 to be completely random, depending on the relative position known from the individual authenticators 1, 2.

Another invention characteristic is the separate and unstable action of authenticators 1, 2 generated by at least a relative movement of one authenticator compared to (with) other (s).

Another characteristic of the new invention are common authenticators 15, 16, 17 generated by the new position from individual authenticators 1, 2 that make it possible to create a new code or signature from which the representation is stored in a local and/or remote database. Another characteristic is the unique and nonreproducible authenticating characteristic of individual authenticators 1, 2 resulting from a chaotic process.

According to another invention characteristic, the authenticating characteristics are visible bubbles auto generated in the material. As an example, this chaotic process can be the formation of bubbles during the aforementioned hardening of the material constituting the authenticator. Thus, contrary to former devices which are the result of a manufacturing process controlled perfectly by man, and thus reproducible by another man having similar tools, each authenticator used in the present invention is unique and impossible to reproduce because it is the result of an uncontrolled process. This characteristic makes it possible to be finally free from the possibility of obtaining authenticators or seals identical to the originals. With the intrinsic security of each authenticator, the second security is added by the sum or rather the combination of the joint action of the authenticators.

According to another characteristic, as physical individual unique authenticators nonreproducible to identical i.e. impossible or extremely difficult to clone, one can use heterogeneities randomly dispersed in a transparent volume. These heterogeneities visibly distinguished are captured for example in the form of photography and one or more representations characterizing this shape of identifier are stored in a memory or a database either in the form of two dimensional images, or in numerical form calculated starting from remarkable elements, of positioning, dimension, etc., of the heterogeneities flooded in volume, the two forms of representation, image and numerical, being able to coexist. In the same way, it is possible to integrate magnetic particles into this identification form, making it possible to codify in another manner.

Another characteristic and a preferred mode are voluminal transparent individual authenticators made out of glass, ceramics, plastic or polymers containing visible bubbles from which the number, the form and the provision result from a noncontrollable chaotic self-generation. This type of authenticator is particularly interesting because it is always unique and not clonable by people. The patent EP01 904039.3 of the same applicant and inventors suggests this type of bubble authenticator with a suitable reading system. In the case of this invention, it is a question of using this bubble authenticator in a particular process where the finality or goal is to block or to prohibit access to systems or locations or to check the integrity or the identity with information associated with an original object. In the same way that previously a representation in the form of image and/or numerical is stored in a database in order to be able to check the integrity of the authenticating characteristic.

According to another characteristic, the memory and/or the database in which a representation of the authenticating characteristic is stored are located physically in the system and/or the protected location and/or on the support itself, but the contents of which can be read outside by an authorized person. This representation of the authenticator constitutes an access key to the physical system and/or logical information. In a practical manner and for many uses, the reader of the authenticated characteristics memorizes the reading carried out at the time of the last movement and automatically compares the new information. In the event of discordance, an audio or luminous signal informs the controller by what means there was opening. Without leaving the framework of this invention, an identifier such as a bar code or electronic (RFID) can be associated with each seal, thus providing an address in the database in order to carry out the comparisons more easily.

According to another to another characteristic, the image and/or numerical representation of the authenticator can be consulted by a standard telecommunications network such as Internet.

In another characteristic, the contents stored in numerical and/or image form can be consulted by a controller or agent authorized in several ways. One way consists of visually comparing the representation in the image form stored in the local and/or remote database with the physical authenticator by analyzing the similarity of positioning of the bubbles or heterogeneities. Several methods exist to visualize the image: either directly on a screen integrated into the system or protected location, or on a dissociated screen or annex (mobile telephone with Internet access), or printed on paper by an integrated printer or using a dissociated printer of the system or protected location. If the database is not local but remote a call code constituting the identifier of the authenticator in the distant database is used, the call code can be numerical, alphanumeric, bar code, magnetic strip, microchip, etc. It is obvious that the database whether local or remote is made secure or protected from any modification attempt or replacement by other information.

Another invention characteristic is the process of monitoring non-intrusion in a system or a protected location or the integrity of an object performed by automatic comparison of the authenticator, using an adapted reader with digital representation stored in a local or remote database.

In the case of a reusable seal, according to the present invention, the authenticating representation stored in a database will change with each new use of the seal, it is this correspondence that is stored in the database and what is really raised on the seal which makes it possible to attest that the seal was not open.

In FIG. 1, a device according to a preferred operational mode of the invention is represented, this constituting only one nonrestrictive example. FIG. 1A shows the open and free device. FIG. 1B, shows the closed and blocked device. FIG. 1C is a top view of the device showing the authenticating part. A cover (4) comprises one authenticator (2) transparent with bubbles (8) generated randomly. This authenticator (2) is fixed on the cover (4) comprising a display window (7). The body (3) comprises one transparent authenticator (1) but the bottom is reflective, for example, silver plated. In the same way as for the authenticator (2), the bubbles (8) were generated randomly. In the body (3) a countersink (10) is provided in which balls (11) can circulate freely. The authenticator (1) is placed on the balls (11) and can move freely on the balls within the limits of its housing. The fastener (5) constitutes the bond which makes it possible to bind the security seal as a whole to the object or the container to be protected. This bond (5) can be removed from the seal through the intermediary device (12) placed blindly in its housing (13). To remove the bond (5) in order to open the container or to reach the protected system, it is necessary to align the passage (14) of the cover (4) with the corresponding portion of the body (3).

In FIG. 1A, the cover (4) is sufficiently unscrewed from the body (3) so that on the one hand it is possible to remove the bond (5) from the body (4) in which it is bound in order to align the opening (14) with the housing (13) and on the other hand, to disunite authenticators (1) and (2). During this operation, authenticator (1), completely free from the balls (11), will move and occupy an unstable random position which will change permanently with the least action exerted on the system. Authenticator (1) and (2) are inaccessible from the outside. In FIG. 1B, the cover (4) is in the closed and blocked position. In this position, the bond (5) is completely attached to the body (3) closed by the cover (4). This position also makes it possible to block authenticators (1) and (2) by pressure and thus stabilize authenticator (1) which was mobile at the time of the open position. Thus this blocked position corresponds necessarily to a new relative and stable position of the authenticators (1) and (2), which is different from the preceding stable position, making it possible to prove that to reach a new stable relative authenticating position it is necessary to free the cover (4). With each stable position being recorded in a database by the position reading associated with the bubbles of two transparent authenticators, it becomes easy to compare all new relative bubble positions and thus to prove the opening leading to this change.

Figure 1A:
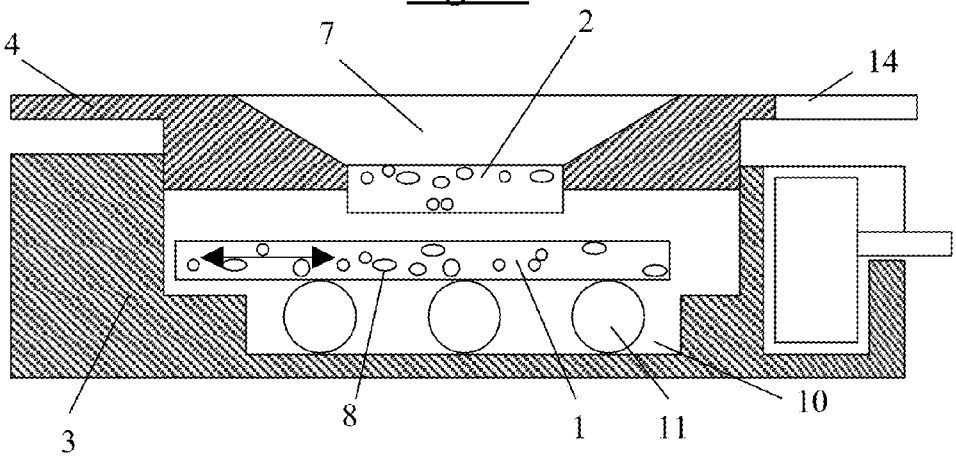
Figure 1B:
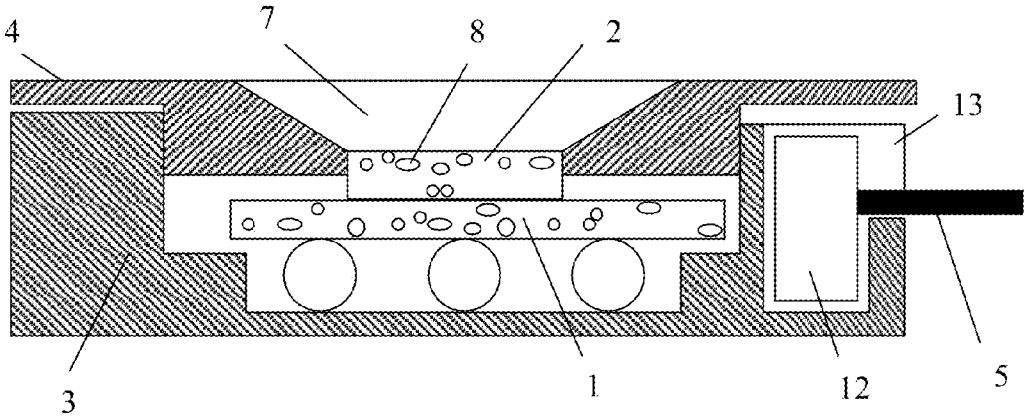
Figure 1C:
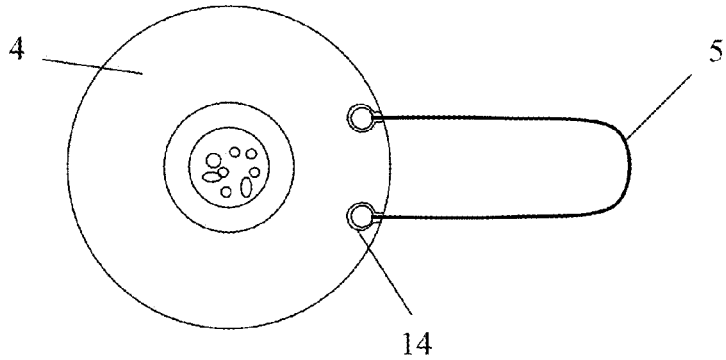
Figure 2:
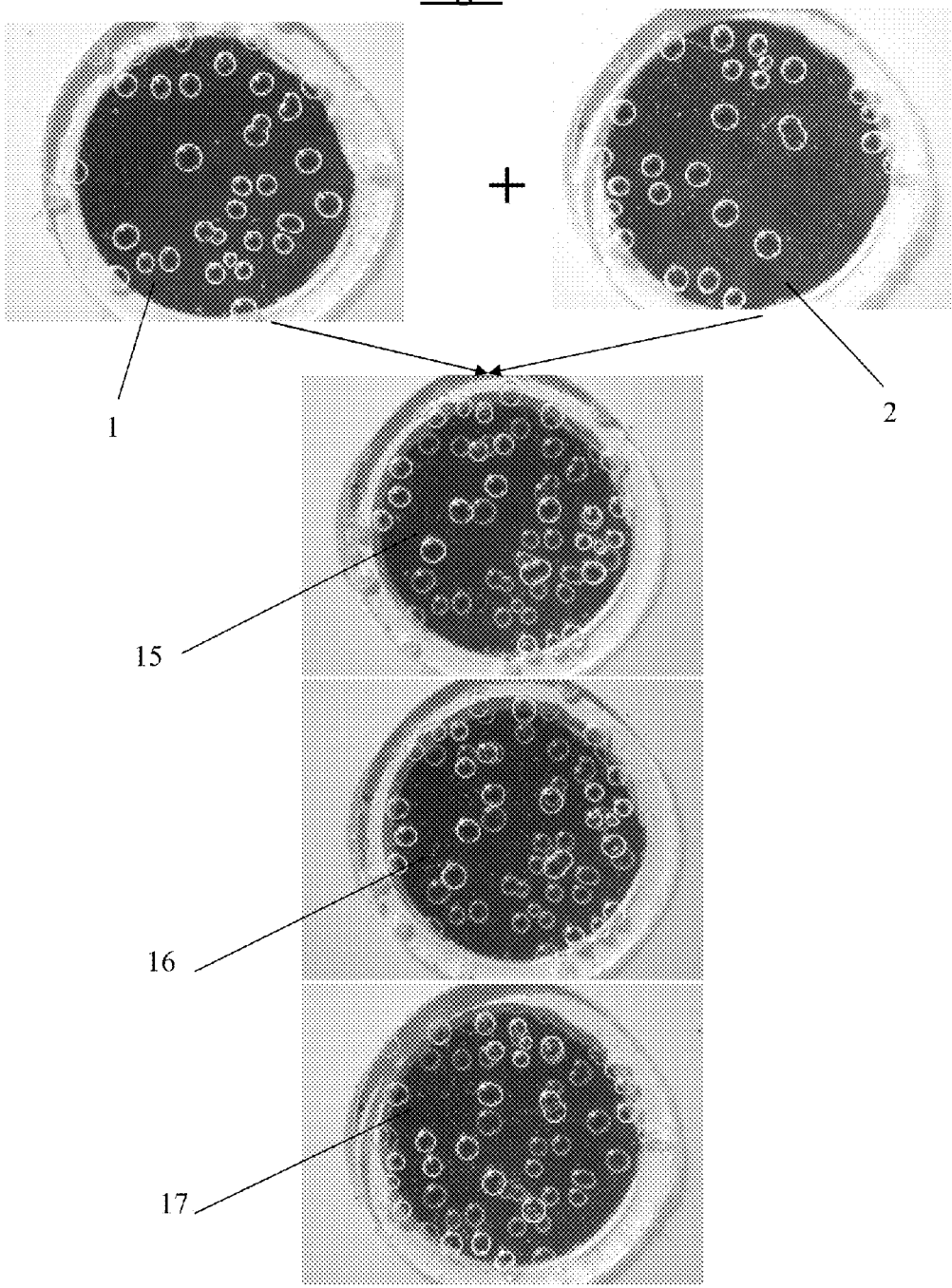
FIG. 2 represents a photograph taken pursuant to the present invention showing the starting position of each authenticator (1) and (2) then successively associated in (15), (16) and (17) after three releases and closings, thus showing the various combinations providing different signatures.
Figure 3:
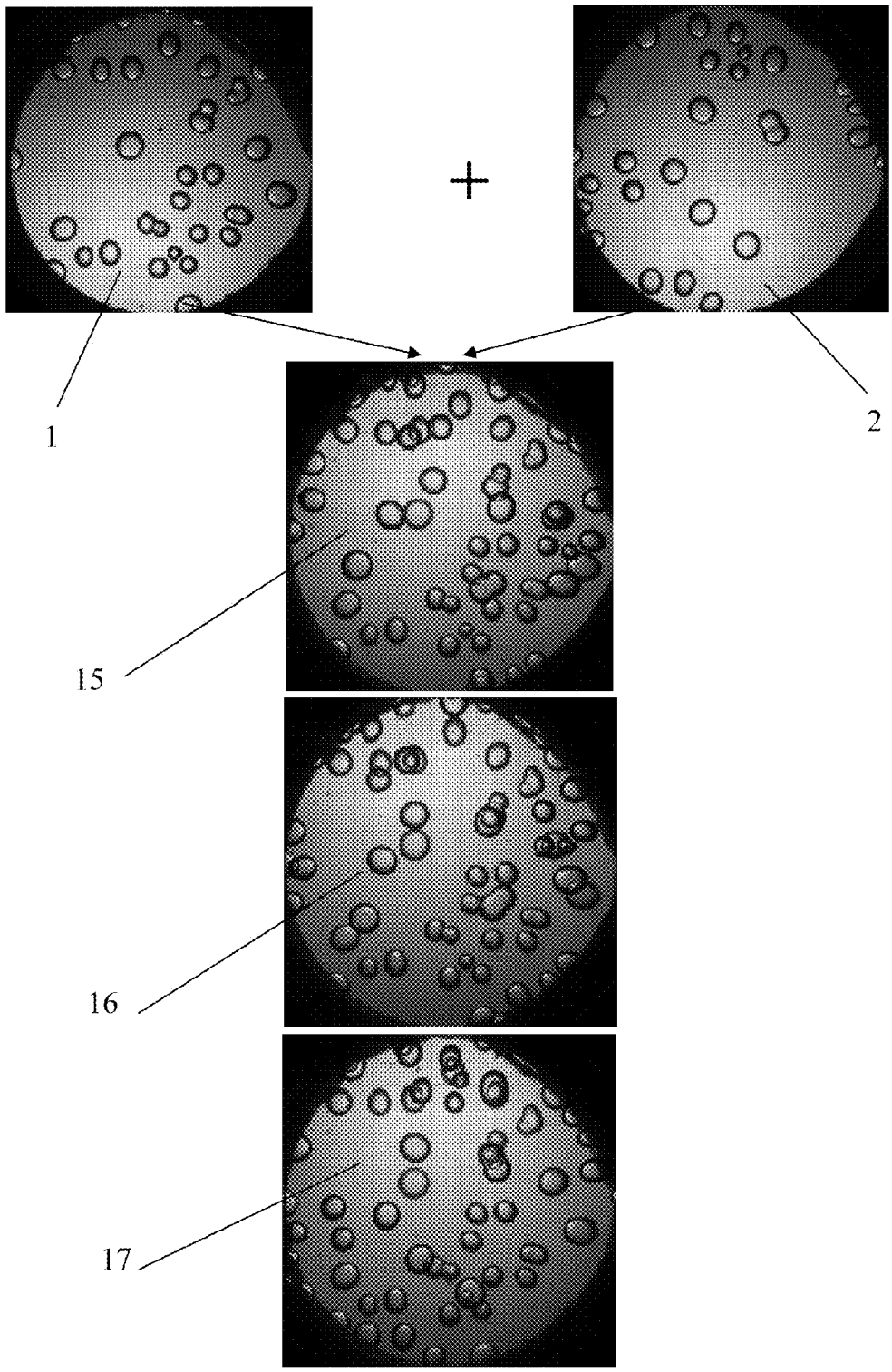
FIG. 3 represents the same thing as FIG. 2 except the fact that the lighting is different, created in another manner by the associated bubbles.

This high security, reusable seal according to the invention will find its place not only in applications requiring a very high level of security, for example the transport of dangerous materials, but also for much more banal applications where the security level required is certainly less, but where the starting investment could be amortized in a very great number of uses, which in the final analysis will cost less than the disposable seals. In this last case, and as an example can be quoted, are the electric, water, and gas meters, etc.

In the same way this type of seal can be used to perform access control by agents in supervised zones while returning, for example using a reader, a new signature resulting from the opening of the seal at the database.

The invention claimed is:

1. A high security reusable seal comprising first and second portions movable with respect to each other to define an open and closed position of the seal;

a display opening in one of the first and second portions of the seal;

at least first and second authentication members located in the seal and displayed through the display opening, the at least first and second authentication member including randomly generated three-dimensional identifying features, at least one moveable member within the seal allowing relative movement between the at least first and second authentication members when the seal is in the open position; wherein, when the seal is moved to the closed position, the closing causes pressure to be applied to at least one of said authentication member, preventing relative movement between the at least first and second authentication members and creating a first authenticating characteristic, when the seal is moved from the closed to the open position, the opening causes said pressure to be released, allowing free relative movement between the at least first and second authentication members and thereby canceling the first authentication characteristic, and when the seal is closed again, the closing again causes pressure to be applied to at least one said authentication member to prevent relative movement between the at least first and second authentication members, creating a second authentication characteristic which is different from the first authentication characteristic.

2. A high security reusable seal as in claim 1 wherein said three-dimensional identifying features are provided by bubbles self-generated in the material of the authenticator members when said members are formed.

3. A high security reusable seal as in claim 1 in combination with a database that records a seal authenticating characteristic that results from an authorized closing of the seal allowing authentication of the seal at a subsequent time by comparison of the recorded seal authenticating characteristic to a subsequent detection of the seal authenticating characteristic of the seal.

4. A high security reusable seal in combination with a database as in claim 3 wherein the recorded seal authenticating characteristic comprises a two-dimensional image of a portion of the authenticator members.

5. A high security reusable seal as in claim 1 wherein said three-dimensional identifying features of each of said authenticator members are detectable by light passing through said members.

6. A high security reusable seal as in claim 5 comprising further a reflective layer on a surface of at least one of said authentication members positioned such that light passing through said authenticator members from one side is reflected back through said authenticator members.

7. A high security reusable seal as in claim 1 wherein at least one moveable member includes balls that are movable within a housing when the seal is in the open position.

* * * * *